US012091848B2

(12) United States Patent
Phillips

(10) Patent No.: US 12,091,848 B2
(45) Date of Patent: Sep. 17, 2024

(54) BOOTH AND AN ACOUSTIC SEAL

(71) Applicant: TRIESTE GROUP ONE LTD, Hempstead (GB)

(72) Inventor: Roger Phillips, Hertfordshire (GB)

(73) Assignee: TRIESTE GROUP ONE LTD, Hemel Hempstead (GB)

( * ) Notice: Subject to any disclaimer, the term of this patent is extended or adjusted under 35 U.S.C. 154(b) by 300 days.

(21) Appl. No.: 17/435,672

(22) PCT Filed: Mar. 5, 2020

(86) PCT No.: PCT/GB2020/050516

§ 371 (c)(1),
(2) Date: Sep. 1, 2021

(87) PCT Pub. No.: WO2020/178583

PCT Pub. Date: Sep. 10, 2020

(65) Prior Publication Data

US 2022/0145616 A1 May 12, 2022

(30) Foreign Application Priority Data

Mar. 6, 2019 (GB) ..... 1903024
Oct. 18, 2019 (GB) ..... 1915148

(51) Int. Cl.
*E04B 1/82* (2006.01)
*E04B 1/343* (2006.01)
(Continued)

(52) U.S. Cl.
CPC ..... *E04B 1/8218* (2013.01); *E04B 1/34315* (2013.01); *E04B 1/34869* (2013.01); *E04H 1/125* (2013.01)

(58) Field of Classification Search
CPC ..... E04B 1/8218; E04B 2001/8263; E04B 1/34315; E04H 1/125
See application file for complete search history.

(56) References Cited

U.S. PATENT DOCUMENTS 2,229,775 A 1/1941 Sherron
2,349,144 A 5/1944 Corso
(Continued)

FOREIGN PATENT DOCUMENTS

CA 1004151 A 1/1977
CH 590 532 A5 8/1977
(Continued)

OTHER PUBLICATIONS

GB Combined Search and Examination Report for Application No. GB1808709.8, mailed Nov. 23, 2018, 6 pages.
(Continued)

*Primary Examiner* — Dedei K Hammond
*Assistant Examiner* — Joseph James Peter Illicete
(74) *Attorney, Agent, or Firm* — Lewis Roca Rothgerber Christie LLP

(57) ABSTRACT

A freestanding booth comprising upstanding peripheral walls, a roof and a base upon which the booth stands in use, one of the walls defining an opening that is closed by a door, wherein the base extends along a basal edge of a first of the walls, the first wall being fixed to the base via a first levelling assembly, the first levelling assembly comprising a first height adjustment mechanism and a second height adjustment mechanism that are spaced apart from one another in a longitudinal direction of the basal edge of the first wall and are independently adjustable for altering an angle of the basal edge of the first wall relative to the ground.

24 Claims, 7 Drawing Sheets

(51) Int. Cl.
*E04B 1/348* (2006.01)
*E04H 1/12* (2006.01)

(56) References Cited

U.S. PATENT DOCUMENTS

| | | | | |
|---|---|---|---|---|
| 2,912,073 | A | 11/1959 | Sherron | |
| 3,514,916 | A | 6/1970 | Hoverman, Jr. | |
| 3,571,994 | A | 3/1971 | Brown et al. | |
| 3,675,379 | A | 7/1972 | Lambert et al. | |
| 3,866,374 | A | 2/1975 | Dallen | |
| 3,885,362 | A * | 5/1975 | Pollock | E04B 2/7409 52/270 |
| 4,006,569 | A | 2/1977 | Kain | |
| 4,831,671 | A | 5/1989 | Harding | |
| 5,060,752 | A | 10/1991 | Heiberger | |
| 5,210,984 | A | 5/1993 | Eckel | |
| 5,682,622 | A | 11/1997 | Tagg | |
| 6,371,240 | B1 * | 4/2002 | Hayes | G10K 11/16 181/295 |
| 10,167,644 | B1 * | 1/2019 | Aliev | E04H 15/48 |
| 11,414,860 | B2 * | 8/2022 | Jungbauer | E04B 2/7403 |
| 2018/0010350 | A1 | 1/2018 | Sansom, III et al. | |
| 2019/0323522 | A1 | 10/2019 | McNair et al. | |

FOREIGN PATENT DOCUMENTS

| | | | |
|---|---|---|---|
| CN | 203961349 | U | 11/2014 |
| DE | 35 03 314 | A1 | 8/1986 |
| DE | 102008057973 | A1 | 5/2010 |
| DE | 10 2009 061 037 | A1 | 2/2011 |
| GB | 1 228 728 | A | 4/1971 |
| GB | 2 230 029 | A | 10/1990 |
| GB | 2 535 631 | A | 8/2016 |
| JP | 9-302962 | A | 11/1997 |
| JP | 2966399 | B1 | 10/1999 |
| JP | 3192588 | B2 | 5/2001 |
| JP | 3159951 | U | 6/2010 |
| JP | 5207181 | B2 | 6/2013 |
| NL | 8900664 | A | 10/1990 |
| WO | 82/02915 | A1 | 9/1982 |
| WO | WO 87/01751 | A1 | 3/1987 |
| WO | 2020/178587 | A1 | 9/2020 |

OTHER PUBLICATIONS

International Search Report of corresponding PCT/GB2020/050516, May 25, 2020, 4 pages.
Written Opinion of the International Searching Authority of corresponding PCT/GB2020/050516, May 25, 2020, 6 pages.
Search Report of corresponding GB 1903024.6, Dec. 16, 2019, 1 page.
International Search Report of corresponding PCT/GB2020/050520, May 26, 2020, 5 pages.
Written Opinion of the International Searching Authority of corresponding PCT/GB2020/050520, May 25, 2020, 6 pages.
Search Report of corresponding GB 1903025.3, Dec. 16, 2019, 1 page.

* cited by examiner

BOOTH AND AN ACOUSTIC SEAL

CROSS-REFERENCE TO RELATED APPLICATION

This application is a U.S. National Phase Patent Application of International Application Number PCT/GB2020/050516, filed on Mar. 5, 2020, which claims priority of British Patent Application Number 1903024.6, filed on Mar. 6, 2019, and British Patent Application Number 1915148.9, filed on Oct. 18, 2019, the entire content of each of which is incorporated herein by reference.

The present disclosure relates to a booth, in particular to an adaptable booth assembly which can be readily relocated. The present disclosure further relates to an acoustic seal, which may be used with the booth.

Open plan working environments, such as office spaces, provide many advantages including the efficient use of available space and the promotion of interaction between workers using the space. However, such open plan environments suffer drawbacks where, for example, workers require a quiet space in which to concentrate on work, conduct meetings or make telephone calls.

To address this issue, some open plan office spaces are provided with a limited number of isolated offices or meetings rooms, which can be used by workers when a quieter or more private environment is required. Such isolated spaces are typically built into the permanent structure of the office space, and are commonly located at or towards the periphery of the office space for convenience.

A disadvantage of this arrangement is that such isolated spaces are generally inflexible and immobile and thus cannot be easily adapted in response to the changing requirements of the users of the office space. For example, an organisation owning or renting an office space may experience fluctuations in the number of workers using the office space, and thus the number of isolated spaces required may vary over time. Similarly, the occupants of a rented office space may change on a regular or semi-regular basis, with different occupants having different requirements in terms of the number or nature of isolated spaces within the office space.

To address these issues the use of freestanding soundproofed booths which can be readily re-located, and which provide a convenient isolated space for a worker in an open plan office environment, are becoming more popular.

Soundproof booths are sealed structures. A problem can arise when re-locating such booths with uneven floors introducing gaps between panels of a booth and a supporting substructure, or between the booth and the floor, which can diminish soundproofing.

The present invention arose in an attempt to provide an adaptable booth which can be readily re-located, and which can provide a convenient isolated space for a worker in an open plan office environment. The booth may preferably further provide a zero threshold entry (or nominal threshold entry) rendering it accessible by all.

According to the present invention in a first aspect there is provided a freestanding booth comprising upstanding peripheral walls, a roof and a base upon which the booth stands in use, one of the walls defining an opening that is closed by a door, wherein the base extends along a basal edge of a first of the walls, the first wall being fixed to the base via a first levelling assembly, the first levelling assembly comprising a first height adjustment mechanism and a second height adjustment mechanism that are spaced apart from one another in a longitudinal direction of the basal edge of the first wall and are independently adjustable for altering an angle of the basal edge of the first wall relative to the ground.

By the provision of a base to which the walls are mounted a stable construction may be provided. The booth may, however, be broken down to a compact form for storage or transportation. The base may be fixed to, or simply placed on, a floor (which may be uneven) and the booth may be built up on the base with the levelling assembly allowing the booth to be suitably levelled to ensure appropriate noise sealing and correct fitment of the door. With the addition of an acoustic seal, as discussed below, even with uneven floor a suitable acoustic seal and soundproofing of the booth may be achieved.

A nominal threshold entry may be achieved by the provision of an extremely low profile base, at least in the floor area and entryway of the booth. The base could, for example, comprise a metal plate or otherwise. In a second aspect, however, there is provided a freestanding booth comprising a plurality of upstanding peripheral walls, a roof and a base upon which the booth stands in use, one of the walls defining an opening that is closed by a door, wherein the base extends along a basal edge of a plurality of the walls but does not extend across the opening.

According to the present invention in a third aspect there is provided an acoustic seal comprising an extrusion, which comprises a body portion and a plurality of deformable protrusions that project from the body portion, the protrusions comprising a first protrusion and a second protrusion that are spaced from one another.

The first and second protrusions may extend from the body portion by different distances.

The body portion is preferably substantially planar.

The protrusions may comprise fins. The fins may be curved when in an un-deformed state. The fins may be tapered in a direction extending away from the body portion. The fin defining the first protrusion may comprise an undercut at a base of the fin where the fin is joined to the body portion.

The extrusion preferably comprises an elastomeric material. It may be formed from silicone.

A surface of the body portion, which is opposed to a surface of the body portion from which the protrusions project, preferably comprises a self-adhesive coating.

The acoustic seal preferably comprises a plurality of the first protrusions.

The first, second and third aspects may be combined with one another in any combination or may be implemented independently of one another.

According to the present application in a fourth aspect, there is provided a soundproof booth comprising upstanding peripheral walls, a roof, a base upon which the booth stands in use, and an acoustic seal, wherein the base extends along a basal edge of at least one of the walls, which comprises an outer panel, and the acoustic seal extends along the basal edge of the wall, sandwiched between the base and the outer panel, for sealing a gap between the outer panel and the base, the acoustic seal comprising an extrusion, which comprises a body portion and a plurality of deformable protrusions that project from the body portion.

The soundproof booth of the fourth aspect may comprise any of the features of the booths of the first and second aspects above.

One of the protrusions is preferably arranged to be compressed between the outer panel and the base, and one of the protrusions is preferably arranged to contact the floor to seal between the base and the floor.

The protrusions may comprise a first protrusion and a second protrusion that are spaced from one another and extend from the body by different distances, the first protrusion arranged to be compressed between the outer panel and the base and being shorter than the second protrusion, which is arranged to contact the floor to seal between the base and the floor.

The acoustic seal preferably extends along the basal edge of each of a plurality of the walls. The acoustic seal may extend around substantially the entire periphery of the base. It may extend continuously around the periphery of the base. The base may be substantially U-shaped.

The acoustic seal may be arranged in accordance with any of the above statements detailing features of the acoustic seal.

Further, preferable, features are presented in the dependent claims.

Non-limiting embodiments of the present invention will now be described, by way of example only, with reference to the accompanying drawings, in which.

Figure 1:
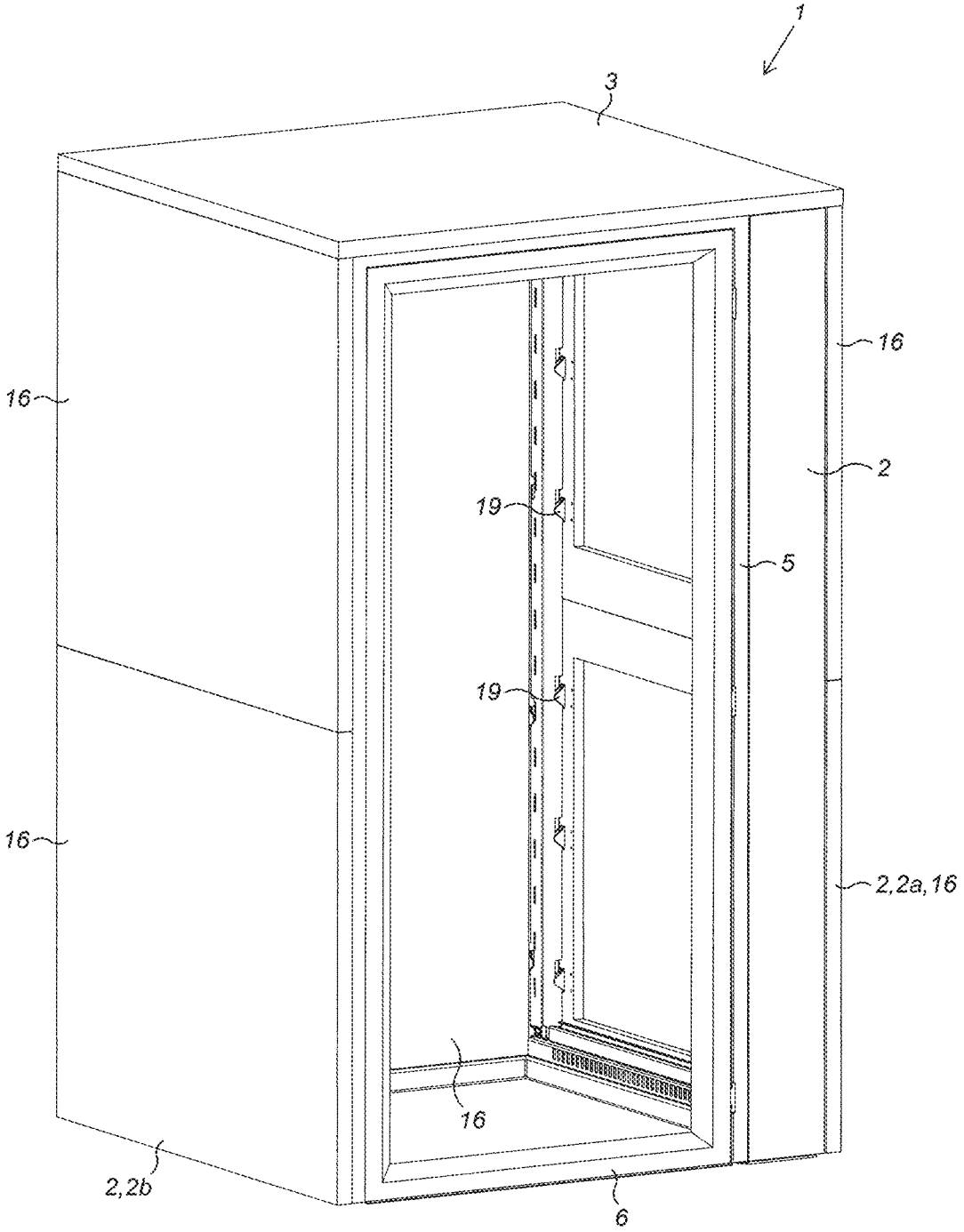
FIG. 1 is a perspective view of a partially assembled booth according to one embodiment of the present invention.

With reference to FIG. 1, there is shown a freestanding booth 1 according to an embodiment of the present invention. The booth 1 is shown in a partially constructed state with inner panels and the door missing. No furniture is installed.

Figure 4:
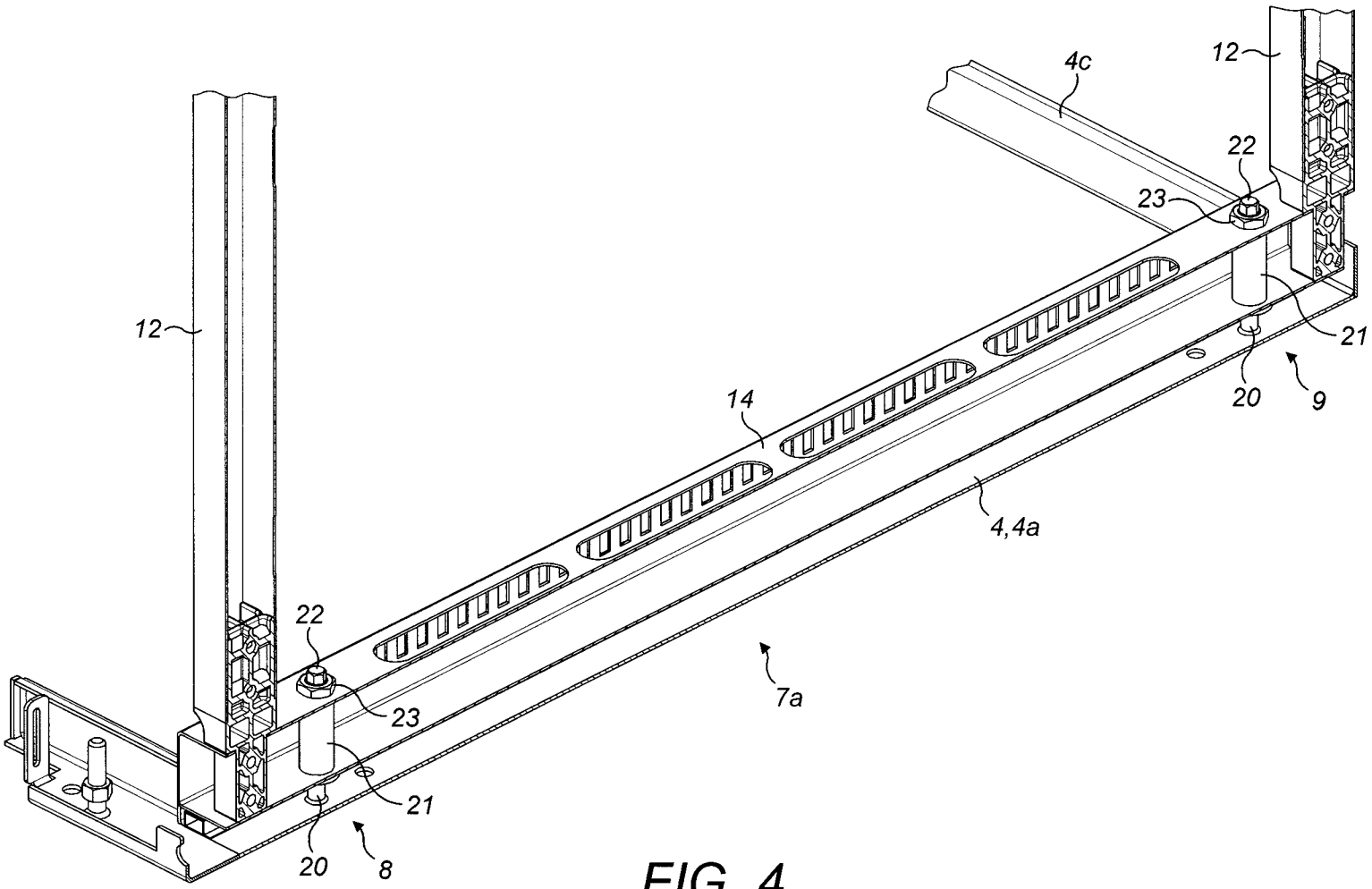
FIG. 4 is a partially cutaway perspective view showing the mounting of a wall frame to the base via a levelling mechanism.

The booth comprises upstanding peripheral walls 2, a roof 3 and a base 4 (as seen in FIGS. 2 to 5) upon which the booth stands in use. One of the walls 2 defines an opening 5 that is closed by a door 6. The base 4 extends along a basal edge of a first of the walls 2*a*, the first wall 2*a* being fixed to the base 4 via a first levelling assembly 7*a* (as seen in FIG. 4). The first levelling assembly 7*a* comprises a first height adjustment mechanism 8 and a second height adjustment mechanism 9 that are spaced apart from one another in a longitudinal direction of the basal edge of the first wall and are independently adjustable for altering an angle of the basal edge of the first wall 2*a* relative to the ground.

As is preferred, in the present arrangement the base 4 extends along a basal edge of a second of the walls 2*b* and the second wall 2*b* is fixed to the base 4 via a second levelling assembly 7*b*. The second levelling assembly 7*b* is preferably of identical construction to the first levelling assembly 7*a* again comprising a first height adjustment mechanism 8 and a second height adjustment mechanism 9 that are spaced apart from one another in a longitudinal direction of the basal edge of the second wall 2*b* and are independently adjustable for altering an angle of the basal edge of the second wall 2*b* relative to the ground. In alternative arrangements the second levelling mechanism could be omitted or could take an alternative form.

The first and second walls 2*a* and 2*b* that are provided with the levelling assemblies 7*a*, 7*b* are opposed to one another in the present arrangement although this need not be the case and will be dependent on the shape of the booth and its configuration.

Whilst in the present arrangement the booth has four walls 2 (and thereby four sides) it could have more or less walls/sides in alternative arrangements. The principals of its construction as discussed in greater detail below will be suitable for constructing booths having numerous forms, including triangular, hexagonal or octagonal booths or otherwise, wherein adjacent sides would be at an oblique angle to one another rather than perpendicular to one another as in the present arrangement. More than this booths could be constructed with curved walls.

Furthermore, whilst the booth is constructed by attaching panels to a sub frame, as discussed below, it should be appreciated that the present invention is applicable to booths that have alternative structures, such as booths formed by attaching complete composite or laminate panels to a base. In such cases, it will not be a frame member that is fixed to the base via the levelling mechanism but an appropriate portion of the alternative panel structure.

Moreover, as discussed, whilst the base extends along a basal edge of a plurality of the walls but does not extend across the opening, there may be arrangements where this is not the case. For example, a nominal threshold entry may be achieved by the provision of an extremely low profile base, at least in the entryway of the booth, in which case the base could extend across the opening. Also, numerous forms of base could be provided, which are not only provided at the periphery of the booth, in contrast to the arrangement shown.

The present invention is not to be limited to the specific structure detailed.

Figure 2:
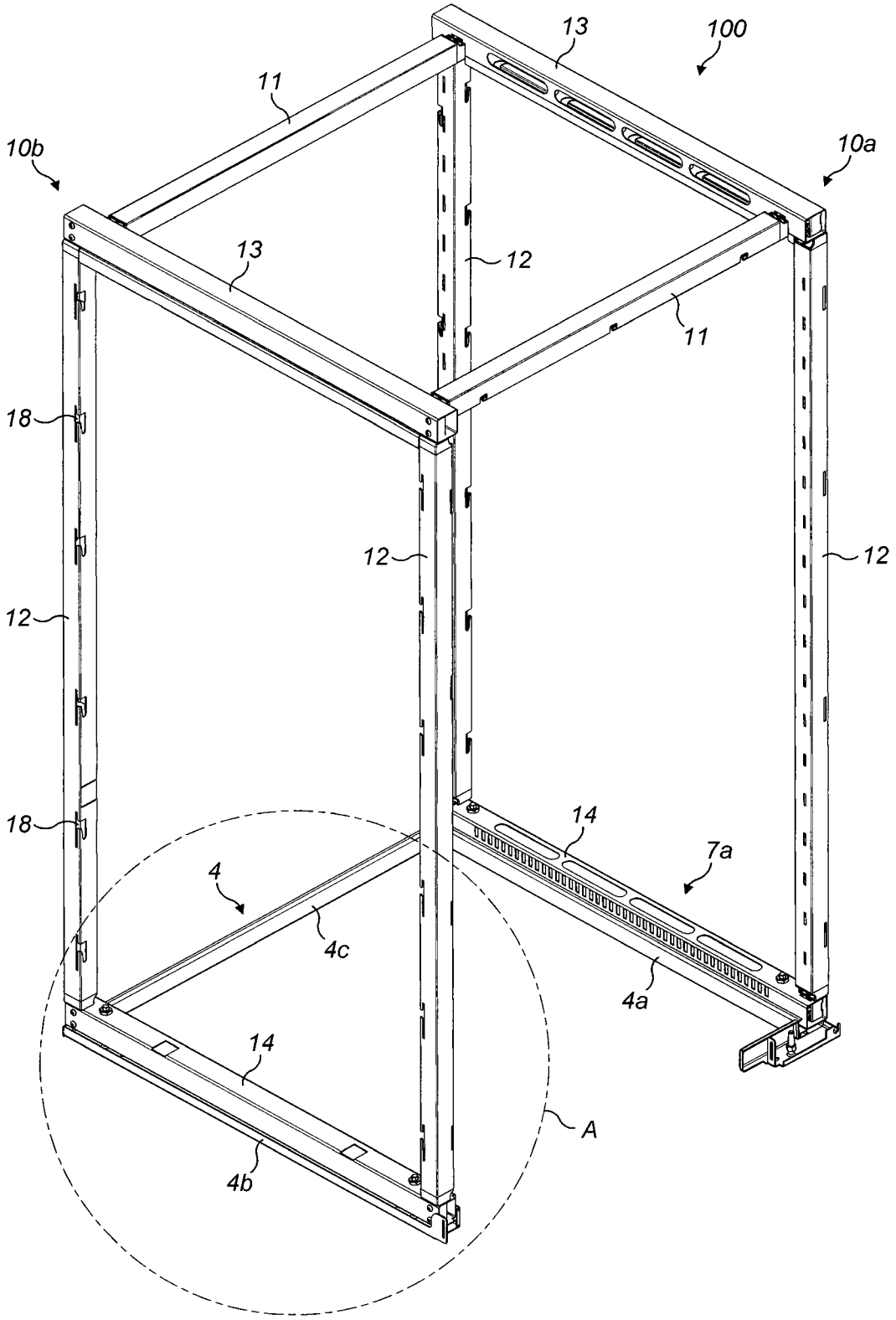
FIG. 2 is a perspective view of a sub frame of the booth of FIG. 1.
Figure 3:
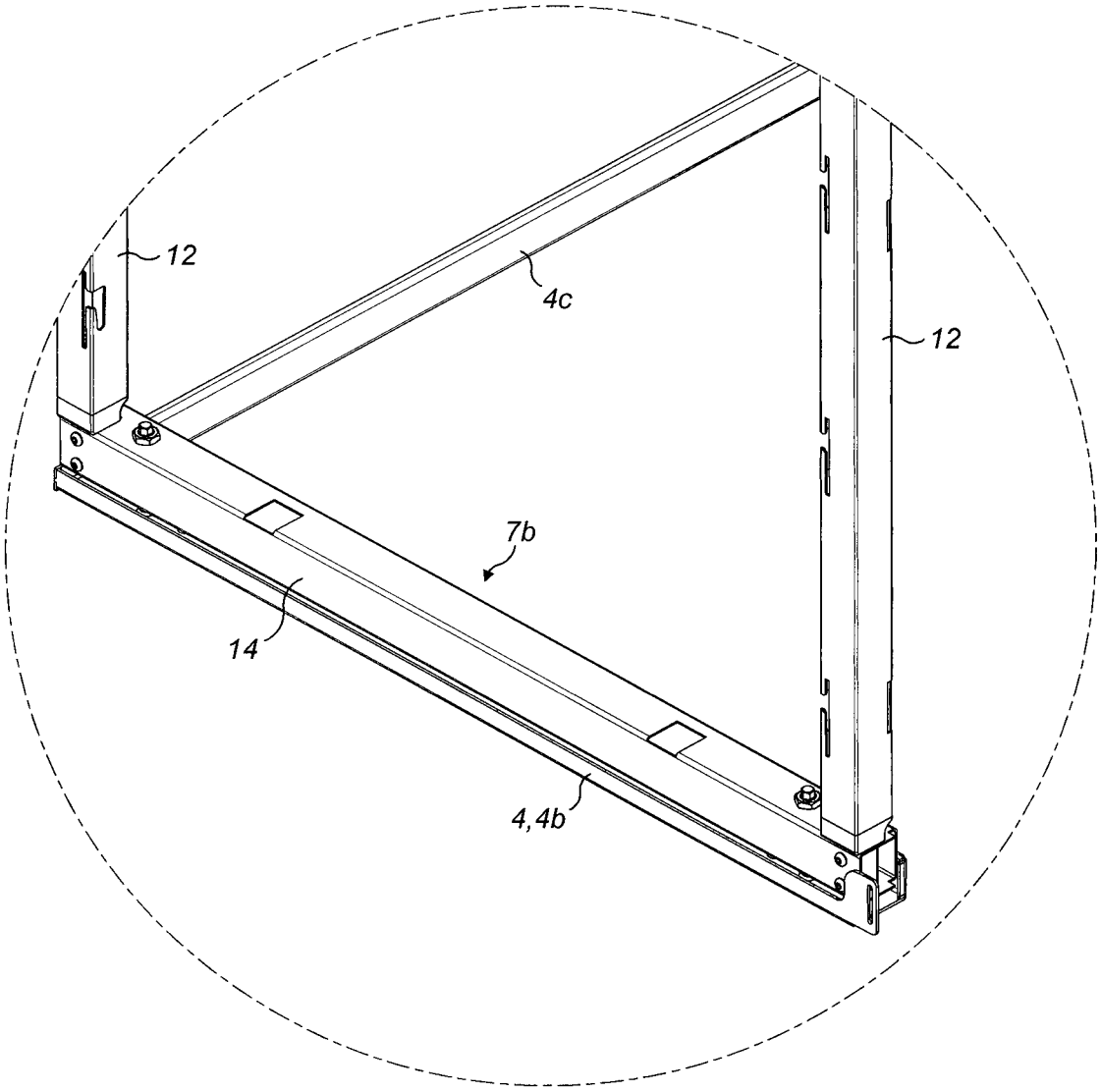
FIG. 3 is a close up view of detail A in FIG. 2.
Figure 5:
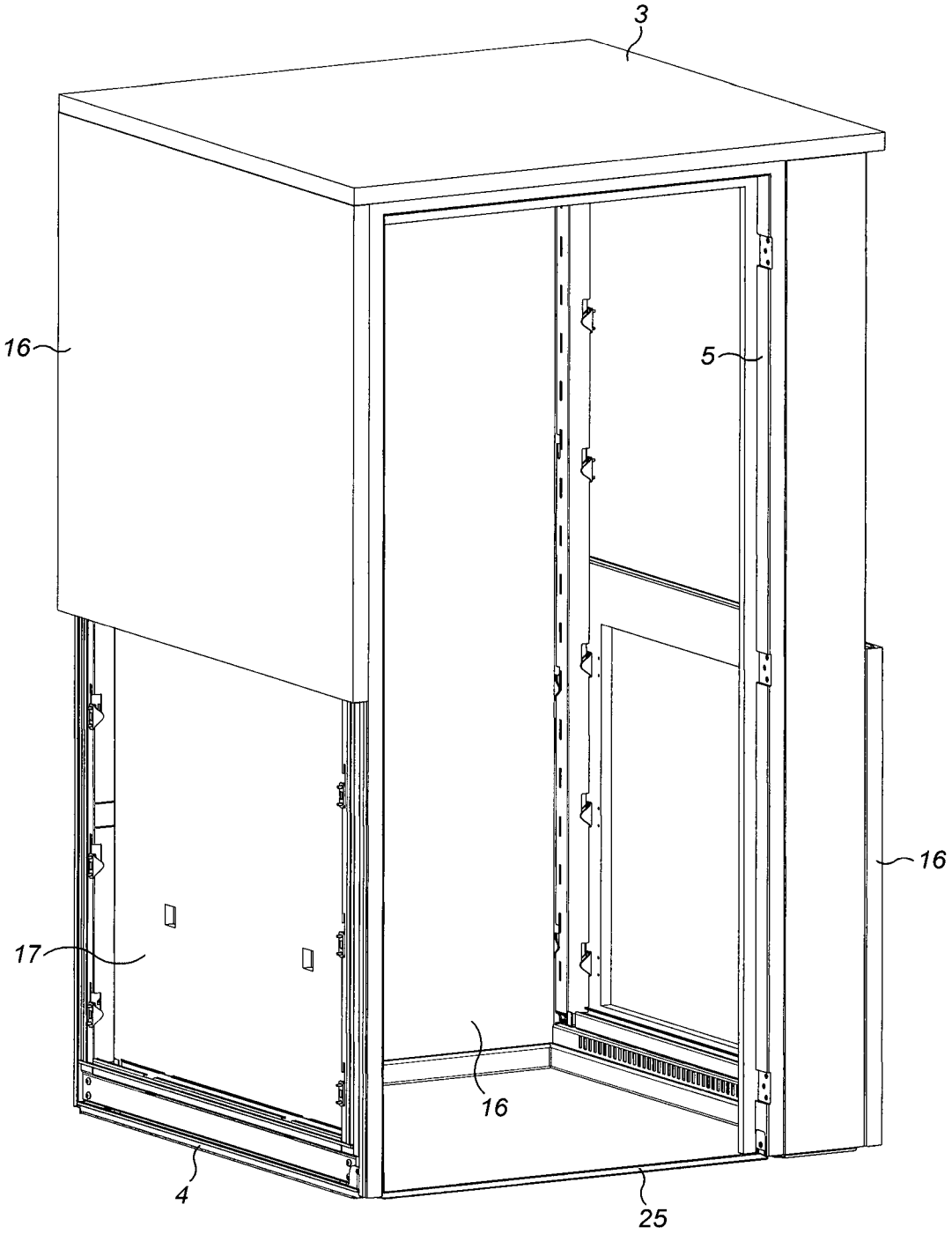
FIG. 5 is a perspective view showing the booth of FIG. 1 partially disassembled by removal of wall panels.

The base 4 extends along (and under) the basal edge of three of the four walls 2, as best seen in FIGS. 2 and 5. It does not extend along the basal edge of the wall 2 that defines the opening 5 that is closed by the door 6. It is, accordingly, substantially U-shaped. The base 4 comprises a plurality of elongate sections 4*a*, 4*b*, 4*c* that are connected to one another. With straight walls, the elongate sections 4*a*, 4*b*, 4*c* are straight. Where curved walls are provided instead then the elongate sections may be correspondingly curved. Adjacent elongate sections in the present arrangement are arranged at a right angle to one another. Where adjacent walls are arranged at angles other than right angles to one another then the angles between adjacent sections 4*a*, 4*b*, 4*c* may also be adapted accordingly.

The base 4 is provided at the periphery of the booth only, as clearly seen. In alternative arrangements, this need not be the case. For example, there could be an arrangement where the base was plate like in form or otherwise constructed to extend across the entire floor surface. The booth 1 preferably comprises no floor. However, arrangements will be possible that include a floor covering, such as a carpet or similar within the booth 1.

The elongate sections 4*a* and 4*b* of the base 4, which extend along the basal edges of the first and second walls 2*a* and 2*b* respectively are formed as U-shaped channels. They are square U-shaped channels in the present arrangement. The U-shaped channels may be provided with sound absorbing material therein. The elongate section 4*c* that extends between the elongate sections 4*a* and 4*b* is not a U-shaped channel but could be in alternative arrangements. In line with the discussion above, in alternative forms of booth there could be more or less U-shaped channels. Moreover, the elongate sections could take numerous alternative forms.

To allow for suitable soundproofing, the base may be provided with sound absorbing material (not shown) on a lower surface that is sandwiched between the base and the floor during use. Additionally or alternatively, the base may comprise sound absorbing material (not shown) on an upper surface of the base, the sound absorbing material being sandwiched between the base and the walls. The sound absorbing material is preferably a suitable foam. Most preferably, there is provided an acoustic seal, as discussed below with reference to FIGS. 6 and 7. Such an acoustic seal may be provided in addition or as an alternative to any other soundproofing measures as discussed herein.

The base 4 may be unitarily formed or, more preferably, formed from separate elongate sections that are joined to one another. By such arrangement, the base may be broken down for storage and transport. Moreover, improved modularity will be possible to allow the construction of booths of different sizes or to interconnect adjacent booths using common elongate sections or otherwise. In one non-limiting example elongate sections 4*a* and 4*b* could be extended to increase the size of the booth.

As best seen in FIG. 2, the booth comprises a sub frame 100. The sub frame 100 is fixed to the base 4. Panels and other structural elements or fixtures may be attached to the sub frame 100. The sub frame 100 comprises frames 10*a* and 10*b*. The frames 10*a* and 10*b* are joined to one another by cross members 11 to form the sub frame 100. The frames 10*a* and 10*b* themselves comprise vertical frame members 12, upper horizontal frame members 13 and basal frame members 14. The first and second walls 2*a*, 2*b* comprise the frames 10*a* and 10*b* respectively.

It should be appreciated that the present invention is not limited to the exemplary frame structure as shown. Numerous alternative frame arrangements will be readily appreciated by those skilled in the art. Whilst two of the walls are shown to comprise frames, which is preferred in the present arrangement, there may be arrangements with more or less frames, particularly where the booth has more or less sides, as discussed.

The walls 2 further comprise panels 16 that are attached to the frames 10*a*, 10*b* (and thereby to the sub frame 100). The roof 3 is formed by the attachment of additional panels.

The panels 16 preferably comprise inner and outer panels, wherein any or all of the walls 2 may comprise at least one inner panel and at least one outer panel, which oppose one another and comprise respective inner and outer faces of the respective wall 2. The walls 2 may comprise multiple smaller inner and/or outer panels or a single inner panel and/or a single outer panel. The inner and outer panels are preferably mounted to the vertical frame members 12, as shown, wherein the vertical frame members comprises either a plurality of vertically spaced lugs or a plurality of vertically spaced hooks that are provided between the inner and outer panels, wherein the inner and outer panels each comprise a corresponding plurality of the other of the vertically spaced hooks or lugs, and the lugs and hooks engage with one another to support the first and second panels on the support element. In the present arrangement, the vertical frame members are provided with the hooks 18 and the panels are provided with the lugs 19.

The lugs 19 are preferably formed by brackets, as shown. The hooks are preferably formed by cut-outs 18 in the vertical frame members 12. The cut-outs may each comprise a slot, which has a width that varies along its length. The slots may be generally L-shaped and extend horizontally for a distance from an open mouth before travelling vertically down to a closed end. The slots may each be tapered to reduce in width between the open mouth of the slot and the closed end of the slot. The closed end of each slot may be curved with a diameter that is substantially equal to the diameter of a cylindrical rod (defining lug 19) of the respective bracket that is received thereby.

It should be appreciated that numerous other means of fixing panels to the sub frame will be possible, as will be readily appreciated by those skilled in the art. The present invention is not to be limited in this regard.

The panels 16 may take any suitable form. They will preferably have sufficient rigidity to prevent sagging. The inner panels may comprise padded fabric panels to provide for acoustic damping. The outer panels may be rigid panels and could be formed from wood, plastic or otherwise. The inner and outer panels could be formed from the same materials or from different materials. There may be sound proofing panels 17 provided between the inner and outer panels. These may be included or omitted in dependence on the acoustic properties of the inner and outer panels.

It is preferable that the outer panels 16 of the walls and the outer panel of the roof are sealed to one another to provide a sealed outer layer. Suitable elastomeric or foam seals may be provided for such purpose, as will be appreciated by those skilled in the art.

The walls 2 may comprise multiple smaller inner and outer panels or a single inner panel and a single outer panel. The use of multiple smaller panels is preferable to allow for more compact transportation or storage when the booth is dismantled. In the present arrangement, as clearly seen in FIG. 1, the first and second walls 2*a*, 2*b* each comprise a pair of outer panels.

The basal frame members 14 define the basal edges of the first and second walls 2*a*, 2*b* respectively that are fixed to the base 4 via the first and second levelling assembly 7*a*, 7*b* respectively. The levelling assemblies will be considered in more detail now with reference to FIG. 4, which shows a partially cutaway view of the first levelling assembly 7*a*.

The levelling assembly 7*a* comprises the first and second height adjustment mechanisms 8, 9, as discussed. The height adjustment mechanisms 8, 9 are identical to one another although could be different to one another in alternative arrangements. The height adjustment mechanisms 8, 9 each comprise a first threaded member 20 that is fixed to the base 4. The first threaded members 20 comprise threaded studs that extend vertically. They could alternatively comprise bolts or otherwise. The first threaded members 20 are each engaged by a respective second threaded member 21 that engages the first threaded member and supports the basal frame member 14 (and thereby the wall 2*a*). The second threaded members 21 take the form of internally threaded sleeves but could take any alternative suitable form. They are provided with externally threaded heads 22 that are received through openings in the basal frame member 14 for receive locking nuts 23. The heads are provided with recesses for receiving an adjustment tool such as a hex driver or similar. With the first and second height adjustment mechanisms independently adjustable, the front and rear ends of the basal frame member 14 may be raised and lowered as desired by rotating the second threaded members 21 to suitably alter the angle of the basal frame member 14 and thereby the basal edge of the wall 2*a* relative to the floor. This allows for a levelling of the booth on an uneven floor.

As seen in FIG. 5, which shows a partially disassembled booth that has had the door 6 removed, a removably attachable threshold member 25 may be provided, which, in use, extends across the opening 5 and along/under a basal edge of the door 6 when the door is in a closed position, the threshold member 25 is attachable to the base at its ends.

In situations where the base is fixed to a floor, as will be required in regions prone to tectonic activity, or otherwise, the threshold member 25 may be omitted. When the base is not fixed to the floor, the threshold member 25 may be used to prevent any twisting of the structure of the booth during use. Also, even when the base is fixed to the floor, the threshold member may be used, when the booth is in general use and when the booth is moved in an assembled state or only when the booth is moved in an assembled state. Notably, its attachment will prevent twisting of the assembled booth during moving.

As may be seen, the threshold member is elongate. It preferably has a very low profile to avoid causing any issue for wheelchair users or otherwise. It may be rotatable about its longitudinal axis for fixing in different orientations. It may take the form of an upturned V in cross-section, wherein it may be angled to overlap a floor covering within the booth (when present) and to slope down outwardly in the direction of the door to hold the edge of the floor covering in place and obviate any tripping risk from the floor covering.

The door is preferably provided with a drop down seal of conventional form that retracts as the door is opened under the force of a spring or otherwise and drops down as the door is shut.

Figure 6:
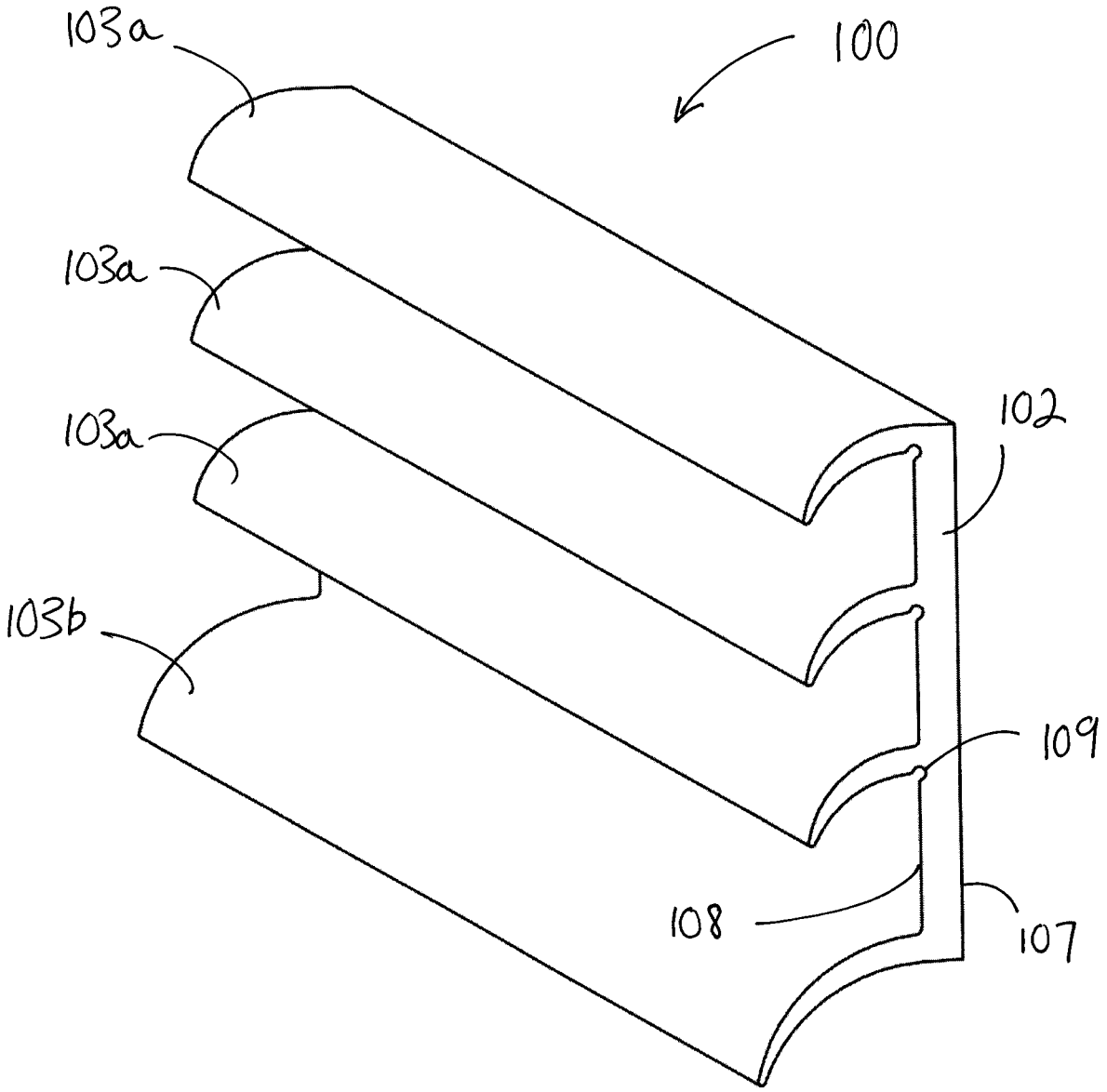
FIG. 6 is a perspective view of a short length of an acoustic seal according to an embodiment.
Figure 7:
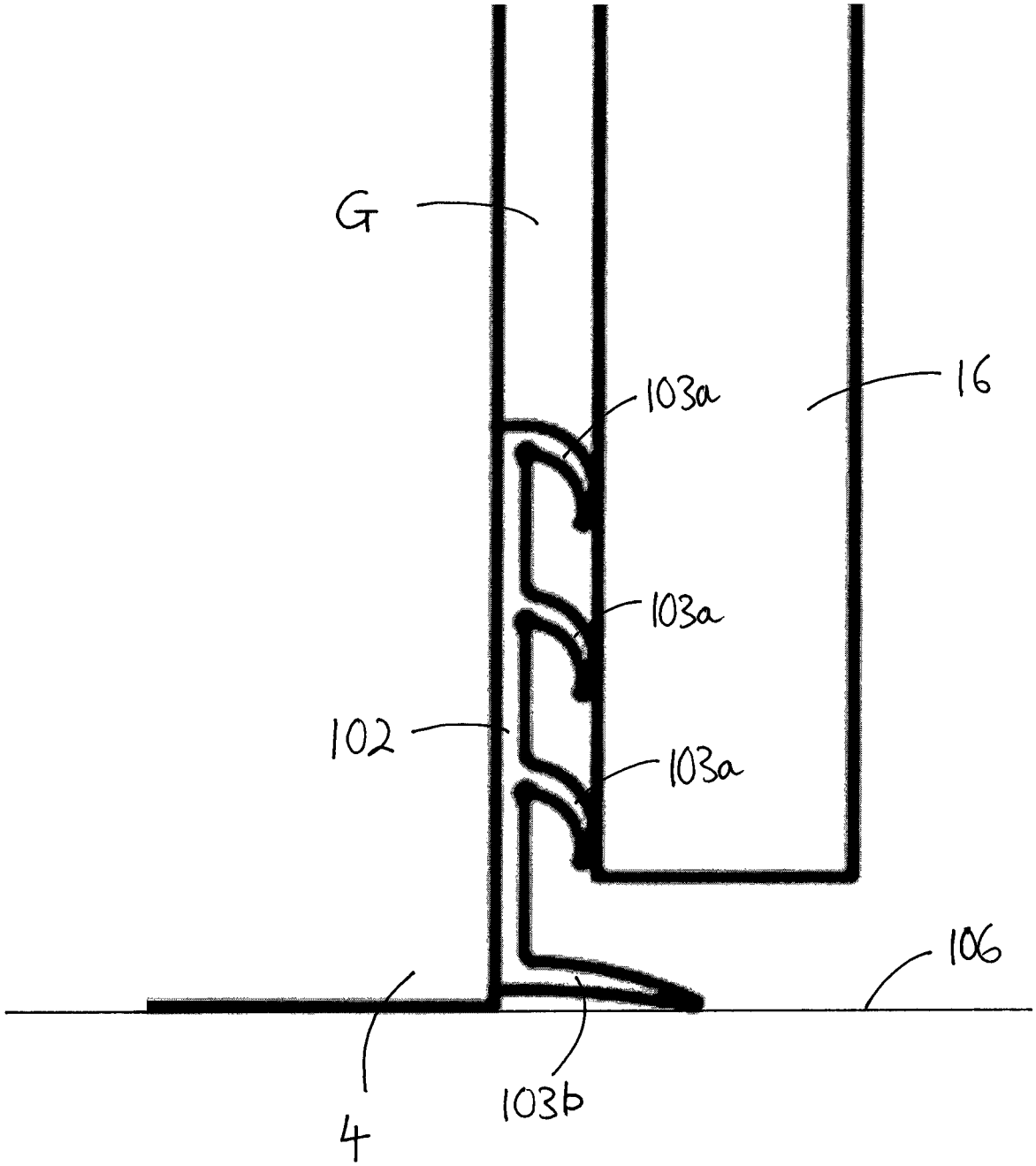
FIG. 7 is a close up schematic view of the seal of FIG. 6 as part of a booth of FIG. 2.

As shown in FIGS. 6 and 7, there is provided an acoustic seal 100. The acoustic seal 100 comprises an extrusion, which comprises a body portion 102 and a plurality of deformable protrusions 103*a*, 103*b* that project from the body portion 102. The protrusions 103*a*, 103*b* comprise first protrusions 103*a* and a second protrusion 103*b*. The protrusions 103*a*, 103*b* are spaced from one another along the body portion, as clearly shown. The second protrusion 103*b* is preferably provided at a basal edge of the acoustic seal in use with the first protrusions 103*a* spaced vertically from the second protrusion 103*a*.

It should be noted that whilst there are a plurality of the first protrusions 103*a* provided and a single second protrusion 103*b*, this need not be the case in alternative arrangements. There could be more or less of the first protrusions 103*a*, including a single first protrusion 103*a* and there could be additional second protrusions 103*b*.

It is preferable that the first and second protrusions 103*a*, 103*b* extend from the body portion 102 by different distances. In the present arrangement, as is preferred, the second protrusion 103*b* projects from the body portion 102 by a greater distance than the first protrusions 103*a*. As seen in FIGS. 6 and 7, and discussed further below, the first protrusions 103*a* are arranged to seal a gap between an outer panel 16 and a base 4 of a booth, which may comprise a booth as discussed above with reference to FIGS. 1 to 5 or otherwise, whilst the second protrusion 103*b* is arranged to seal between the base 4 and the floor 106.

The body portion 102 is preferably substantially planar, as shown, but could take alternative forms, particularly due to its flexibility. A surface 107 of the body portion 102, which is opposed to a surface 108 of the body portion 102 from which the protrusions 103*a*, 103*b* project, preferably comprises a self-adhesive coating for attaching the acoustic seal 100 to appropriate surfaces during use.

The protrusions 103*a*, 103*b* may comprise fins, as shown, or may take alternative suitable forms. For example, they could be hollow and square, triangular or round in profile.

The fins are preferably curved when in an un-deformed state, as shown in FIG. 6. The fins could alternatively be straight. The fins are preferably angled downward in use, as seen in FIG. 7. The fins may be tapered in a direction extending away from the body portion, as seen in FIGS. 6 and 7, such that they get thinner towards their free ends.

Each of the fins defining one of the first protrusions 103*a* is preferably provided with an undercut 109 at a base of the fin where the fin is joined to the body portion 102. The use of an undercut 109 helps in the provision of a stiffer rib, less prone to collapse and better prone to resiling, whilst allowing for sufficient collapsibility to avoid undesirable spacing between the elements it is sandwiched between. The fin defining the second protrusion 103*b* could also comprise an undercut 109

The extrusion preferably comprises an elastomeric material. The material is not particularly limited so long as it exhibits good resilience. Silicone has been found to be a particularly suitable material.

With reference to FIG. 7, the acoustic seal 100 is further considered in use in a booth, which booth may include any of the features discussed above in respect of the booths in FIGS. 1 to 5 in any suitable combination.

The acoustic seal 100 extends along the basal edges of each of a plurality of the walls, sandwiched between the base and the outer panel, for sealing a gap G between the outer panel 16 and the base 4.

The first protrusions 3*a* are arranged to be compressed between the outer panel 16 and the base 4, and the second protrusion 103*b* is arranged to contact the floor to seal between the base 4 and the floor 106.

With a plurality of the first protrusions 103*a* spaced vertically from one another during use, a small range of vertical misalignments of the outer panel 16 may be accommodated.

As discussed, the acoustic seal 100 preferably extends along the basal edge of each of a plurality of the walls 2. The acoustic seal may extend around substantially the entire periphery of the base 4. It may extend continuously around the periphery of the base. In the present arrangement with the base being substantially U-shaped, the acoustic seal 100 extends continuously around three basal edges of the booth. The acoustic seal 100 preferably extends along the basal edge of the side with the door 6 on either side of the door as far as the door opening. As discussed, the door is preferably provided with a drop down seal (not shown) of conventional form that retracts as the door is opened under the force of a spring or otherwise and drops down as the door is shut. It may alternatively be provided with an alternative form of seal. With a seal under the door there is provided an unbroken basal peripheral seal (around the entire periphery of the booth). The door/opening is/are preferably further provided with suitable sealing such that the opening is sealed by the door when closed. The outer panels, including the outer panel(s) one the walls and roof are preferably sealed with one another, such that when the door is shut a sealed volume is defined. A suitable ventilation system may be provided to allow for suitable airflow/cooling during use.

The invention has been described above with reference to specific embodiments, given by way of example only. It will be appreciated that many different arrangements of are possible within the scope of the appended claims, including by combining different combinations of the features discussed herein.

The invention claimed is:

1. A freestanding booth comprising upstanding peripheral walls, a roof and a base upon which the booth stands in use, one of the walls defining an opening that is closed by a door, wherein the base extends along a basal edge of a first of the walls, the first wall being fixed to the base via a first levelling assembly, the first levelling assembly comprising a first height adjustment mechanism and a second height adjustment mechanism that are spaced apart from one another in a longitudinal direction of the basal edge of the first wall and are independently adjustable for altering an angle of the basal edge of the first wall relative to the ground, wherein one or more of the walls comprises a frame that is fixed to the base and one or more wall panels that are fixed to the frame, wherein each of the first and second height adjustment mechanisms comprises a first threaded member fixed to the base and a second threaded member that engages the first threaded member and supports the respective wall, and wherein the first wall comprises one of the frames, which comprises an elongate basal frame member that is supported by the respective second threaded members.

2. The booth as claimed in claim 1, wherein the base extends along a basal edge of a second of the walls, the second wall being fixed to the base via a second levelling assembly, the second levelling assembly comprising a first height adjustment mechanism and a second height adjustment mechanism that are spaced apart from one another in a longitudinal direction of the basal edge of the second wall and are independently adjustable for altering an angle of the basal edge of the second wall relative to the ground.

3. The booth as claimed in claim 2, wherein the first and second walls are opposed to one another.

4. The booth as claimed in claim 1, wherein a plurality of the walls comprises frames that are joined together to form a booth sub frame.

5. The booth as claimed in claim 1, wherein each of the one or more walls comprising a frame comprises two or more wall panels that include an inner panel and an outer panel, which oppose one another and comprise respective inner and outer faces of the wall, the frame comprising a vertically extending support element to which the inner and outer panels are mounted, wherein the support element comprises either a plurality of vertically spaced lugs or a plurality of vertically spaced hooks that are provided between the inner and outer panels, wherein the inner and/or outer panels each comprise a corresponding plurality of the other of the vertically spaced hooks or lugs, and the lugs and hooks engage with one another to support the first and/or second panels on the support element.

6. The booth as claimed in claim 1, wherein the base comprises sound absorbing material on an upper surface of the base, the sound absorbing material being sandwiched between the base and the walls.

7. The booth as claimed in claim 1, wherein the base is provided with sound absorbing material on a lower surface that is sandwiched between the base and the floor during use.

8. A soundproof booth comprising the booth of claim 1 and an acoustic seal, the acoustic seal comprising an extrusion, which comprises a body portion and a plurality of deformable protrusions that project from the body portion.

9. The soundproof booth as claimed in claim 8, wherein the body portion is substantially planar.

10. The soundproof booth as claimed in claim 8, wherein the protrusions comprise fins.

11. The soundproof booth as claimed in claim 10, wherein the fins are curved when in an un-deformed state.

12. The soundproof booth as claimed in claim 10, wherein the fins are tapered in a direction extending away from the body portion.

13. The soundproof booth as claimed in claim 8, wherein the protrusions comprise a first protrusion and a second protrusion that are spaced from one another and extend from the body portion by different distances.

14. The soundproof booth as claimed in claim 13, wherein the protrusions comprise fins and the fin defining the first protrusion comprises an undercut at a base of the fin where the fin is joined to the body portion.

15. The soundproof booth as claimed in claim 8, wherein a surface of the body portion, which is opposed to a surface of the body portion from which the protrusions project, comprises a self-adhesive coating.

16. The soundproof booth as claimed in claim 13 comprising a plurality of the first protrusions.

17. The soundproof booth as claimed in claim 8, wherein the base extends along a basal edge of at least one of the walls, which comprises an outer panel, and the acoustic seal extends along the basal edge of the wall, sandwiched between the base and the outer panel, for sealing a gap between the outer panel and the base.

18. The soundproof booth as claimed in claim 17, wherein one of the protrusions is arranged to be compressed between the outer panel and the base, and one of the protrusions is arranged to contact the floor to seal between the base and the floor.

19. The soundproof booth as claimed in claim 18, wherein the protrusions comprise a first protrusion and a second protrusion that are spaced from one another and extend from the body by different distances, the first protrusion arranged to be compressed between the outer panel and the base and being shorter than the second protrusion, which is arranged to contact the floor to seal between the base and the floor.

20. The soundproof booth as claimed in claim 8, wherein the acoustic seal extends along the basal edge of each of a plurality of the walls.

21. The soundproof booth as claimed in claim 8, wherein the acoustic seal extends around substantially an entire periphery of the base.

22. The soundproof booth as claimed in claim 8, wherein a seal is provided on a basal edge of the door.

23. The soundproof booth as claimed in claim 17, wherein each of the walls and the roof comprises one or more outer panels, there being provided seals between the panels so that the outer panels form a sealed outer structure.

24. The soundproof booth as claimed in claim 23, wherein the door comprises a perimeter seal, such that with the door closed there is a sealed volume is defined by the outer panels and the door.

* * * * *